US008567785B1

(12) United States Patent
Cheng

(10) Patent No.: US 8,567,785 B1
(45) Date of Patent: Oct. 29, 2013

(54) INTELLECTUAL GAME MODEL

(76) Inventor: Ming-Hsien Cheng, Taipei (TW)

( * ) Notice: Subject to any disclaimer, the term of this patent is extended or adjusted under 35 U.S.C. 154(b) by 0 days.

(21) Appl. No.: 13/455,087

(22) Filed: Apr. 24, 2012

(51) Int. Cl.
*A63F 3/00* (2006.01)

(52) U.S. Cl.
USPC ..... 273/287; 273/275

(58) Field of Classification Search
USPC ..... 273/275, 287, 264, 282.3; 446/128
See application file for complete search history.

(56) References Cited

U.S. PATENT DOCUMENTS 3,487,579 A * 1/1970 Brettingen ..... 446/128
3,695,615 A * 10/1972 Shoptaugh ..... 273/275
4,183,167 A * 1/1980 Jatich ..... 446/118
4,226,421 A * 10/1980 Shimizu ..... 273/275
4,529,206 A * 7/1985 Curry et al. ..... 273/261
D370,034 S * 5/1996 Kipfer ..... D21/502
D423,123 S * 4/2000 Sassenberg ..... D25/152

* cited by examiner

*Primary Examiner* — Vishu K. Mendiratta

(57) ABSTRACT

Present invention provides an intellectual game model which includes a base with several grooves, level selector and 7 chain hexagonal bricks. There are 8 hexagon docks with numbers, and player is capable of selecting the level of difficulty of the game by moving level selector. There is also a hexagonal stud which is for increasing the difficulty of the game. Player uses 7 chain hexagonal bricks with different shapes to complete the shape which is built by empty grooves. The game inspires player's intelligence and is suitable for beginner or the one who want to challenge difficult levels of the game.

5 Claims, 13 Drawing Sheets

INTELLECTUAL GAME MODEL

FIELD

Present invention relates to an intellectual game which plays with chain hexagonal bricks and base.

BACKGROUND OF INVENTION

The inventor of present invention has invented many intellectual building bricks and puzzle games which are patented or applying for patents worldwide.

However, in priority art, the assistant such as selector, cards, positioning blocks and dice are needed if there are many ways to accomplish the game or the difficulty of the game is changeable, which increases the amount of elements of the game, and cause some problems about the storage of these elements; moreover, the structure of original building bricks is complicated and requiring high price of production, the price of the game is going to become more expensive if there are more elements which are applied in the game, and cause disadvantages to the consumer. Therefore, to invent a cheap intellectual game with simple structure, few elements, playing in multiple ways and changeable difficulties has become the main issue of present invention.

Present invention provides an intellectual game with special structure, changeable and rapid shifting difficulties, playing capability for beginner and challenger, multiple ways of playing, cheap price and inspiration of intelligence.

SUMMARY OF THE INVENTION

To achieve the object, the embodiment of present invention includes a base (10) with several grooves (11), a level selector (H) which is disposal on said groove (11), and 7 chain hexagonal bricks (A-G) with different shape which is disposal on said groove (11); there are 3 lists of hexagonal docks (12) which are disposed from the left to the right hand side of the top of said base (10); there are 3 hexagonal docks (12) on the first and third list, and 2 hexagonal docks (12) are on second list. Total 8 hexagonal docks (12) are lined in alternate permutation. There are 6 grooves (11) around every hexagonal docks (12), but there is only one groove (11) between 2 close hexagonal docks (12), and there is a hexagonal stud (W) which is disposed on one of said grooves (11), therefore, there are only 34 grooves (11) on the base (10) which are empty in the game; furthermore, there are numbers (N) which represent the levels of difficulty of the game, being printed on the vertex of said hexagonal docks (12).

Said level selector (H) is assembled by a hexagonal large cover (31) which is large enough to cover one of said hexagonal docks (12), and 2 small hexagonal covers (32) which are connected to said hexagonal large cover (31) and large enough to cover 2 of said grooves (11). Said 2 small hexagonal covers (32) are conjunct, and there is a window (34) among said hexagonal large cover (31) and 2 small hexagonal covers (32) for watching said numbers (N). Said 7 chain hexagonal bricks (A-G) are assembled by chain units (41) which are hexagonal columns, herein the first to third chain hexagonal bricks (A-C) are assembled by 4 chain units (41); fourth to seventh chain hexagonal bricks (D-G) are assembled by 5 chain units (41). There are totally 32 chain units (41) in whole game model.

Furthermore, there is a hexagonal slot (13) which is in the center of each Said hexagonal dock (12), and there is a hexagonal column (33) which is disposed on the center of the bottom of said large hexagonal cover (31) on the level selector (H) and said hexagonal slot (13) is insertable by said hexagonal column (33).

Furthermore, there is a protruding hexagonal plug (14) on each of said 34 grooves (11) which is disposed on the center of the bottom of said groove (33); said 2 small hexagonal covers (32) on said level selector (H) are with protruding frames (35) which are more thick than said large hexagonal cover (31). There are 2 banks (36) on each of said protruding frames (35) which is pluggable by said protruding hexagonal plug (14) and become fixed when said protruding hexagonal plug (14) plugs into said banks (36) which are on each of said protruding frames (35).

Furthermore, shapes of said 7 chain hexagonal bricks (A-G) are as follow:

First chain hexagonal bricks (A): The C shape part is assembled by 3 chain units (41*a*-41*c*). The include angle between each 2 chain units (41) is 120 degrees. Fourth chain unit (41*d*) is attached between (41*a*) and (41*b*) with 120 degrees of include angle between (41*a*) and (41*b*).

Second chain hexagonal bricks B is assembled by 3 chain units (41*a*-41*c*) which are conjunct each other with 120 degrees of include angle and become a C shape.

Third chain hexagonal bricks (C): The C shape part is assembled by 3 chain units (41*a*-41*c*). The included angle between each 2 chain units (41) is 120 degrees; fourth chain unit (41*d*) is connected to another side of (41*c*) in reversal direction.

Fourth chain hexagonal bricks (D): The C shape part is assembled by 4 chain units (41*a*-41*d*); The include angle between each 2 chain units (41) is 120 degrees. Fifth chain unit (41*e*) is attached between (41*a*) and (41*b*) with 120 degrees of include angle between (41*a*) and (41*b*).

Fifth chain hexagonal bricks (E): The C shape part is assembled by 4 chain units (41*a*-41*d*); The include angle between each 2 chain units (41) is 120 degrees. Fifth chain unit (41*e*) is attached between (41*b*) and (41*c*) with 120 degrees of include angle between (41*b*) and (41*c*).

Sixth chain hexagonal bricks (F) is assembled by 5 chain units (41*a*-41*e*) which are conjunct each other with 120 degrees of include angle and become a C shape.

Seventh chain hexagonal bricks (G): The C shape part is assembled by 4 chain units (41*a*-41*d*), and the include angle between each 2 chain units is 120 degrees. Fifth chain unit (41*e*) is connected to another side of (41*d*) in reversal direction.

Furthermore, said chain unit (41) is assembled by a hexagonal column (44) and a horizontal protruding joint (42) which is disposed on relative sides of said chain unit (41). The include angle of the free end of said horizontal protruding joint (42) is 120 degrees; said chain hexagonal bricks herein said chain unit (41) are connect by said horizontal protruding joint (42).

Furthermore, said hexagonal stud (W) has better not be disposed on the grooves (11) which are disposed on the edge of said base (10).

Player must fill in every empty grooves (11) on the base (10) with said 7 chain hexagonal bricks (A-G) to accomplish the game.

The practice of said embodiment achieves the following objects:

There are 6 numbers (N) which are printed on the vertex of said every hexagonal docks (12), each number (N) represent a shape which is formed by said grooves (11). If the value of said number (N) is smaller, there are more ways to fill in grooves (11) with said 7 chain hexagonal bricks (A-G), otherwise, if the value of said number (N) is bigger, there are less ways to fill in grooves (11) with said 7 chain hexagonal bricks (A-G), and the game becomes more difficult; there are multiple numbers (N) in the game which means the game is selective and suitable for beginners or the one who want to challenge more difficult levels.

One of said hexagonal docks (12) and 2 of said grooves (11) are covered when said level selector (H) is disposed on said base (10), and there are 6 positions in different directions on said hexagonal dock (12), therefore, there are 48 positions for disposing said level selector (H) on said 8 hexagonal docks (12) which create 48 levels of difficulty of the game. Players choose the difficulty of this intellectual game only by move the level selector (H), moreover, the window (34) on the said level selector (H) is on the top of one of said numbers (N) which is printed on said hexagonal docks (12). That means the level of difficulty of the game is visible by player which both are innovative designs and never present in prior art.

The said hexagonal stud (W) is disposed on said base (10) which is for stopping and interrupting filling in empty grooves (11) with said hexagonal chain hexagonal bricks (A-G). The difficulty of the game is increased by this design, thus the intelligence of player is inspired. Furthermore, the grooves (11) and hexagonal docks (12) on the base (10) are aligned symmetrically from left to right and upward to downward. That means half of shapes which are formed by empty grooves are the same, thus, the disposing of said hexagonal stud (W) is also for preventing happening of this situation.

The shapes of said chain hexagonal bricks (A-G) are different which are assemble by 4 or 5 chain units (41). Said chain units (41) are solid hexagonal columns (44) with hexagonal sockets (43) which are on the upward and downward surface of said hexagonal columns (44). Said socket (43) is insertable by said protruding hexagonal plug (14) which is disposed in every groove (11). Said chain units (41) are fixed to the base (10) when by said protruding hexagonal plug (14) is inserted into said socket (43), and combine as a chain if multiple chain units (41) are series connected. The way of connection and fix structure of chain hexagonal bricks are different with prior building brick intellectual games.

The structure of said base (10), 7 chain hexagonal bricks (A-G) and level selector (H) are simple, easy to make and manufacture, and also easy to store, therefore, the price of production of the game is reduced and the selling price become much cheaper which fit the interest of consumer and economic benefits.

DETAIL DESCRIPTION

Figure 1:
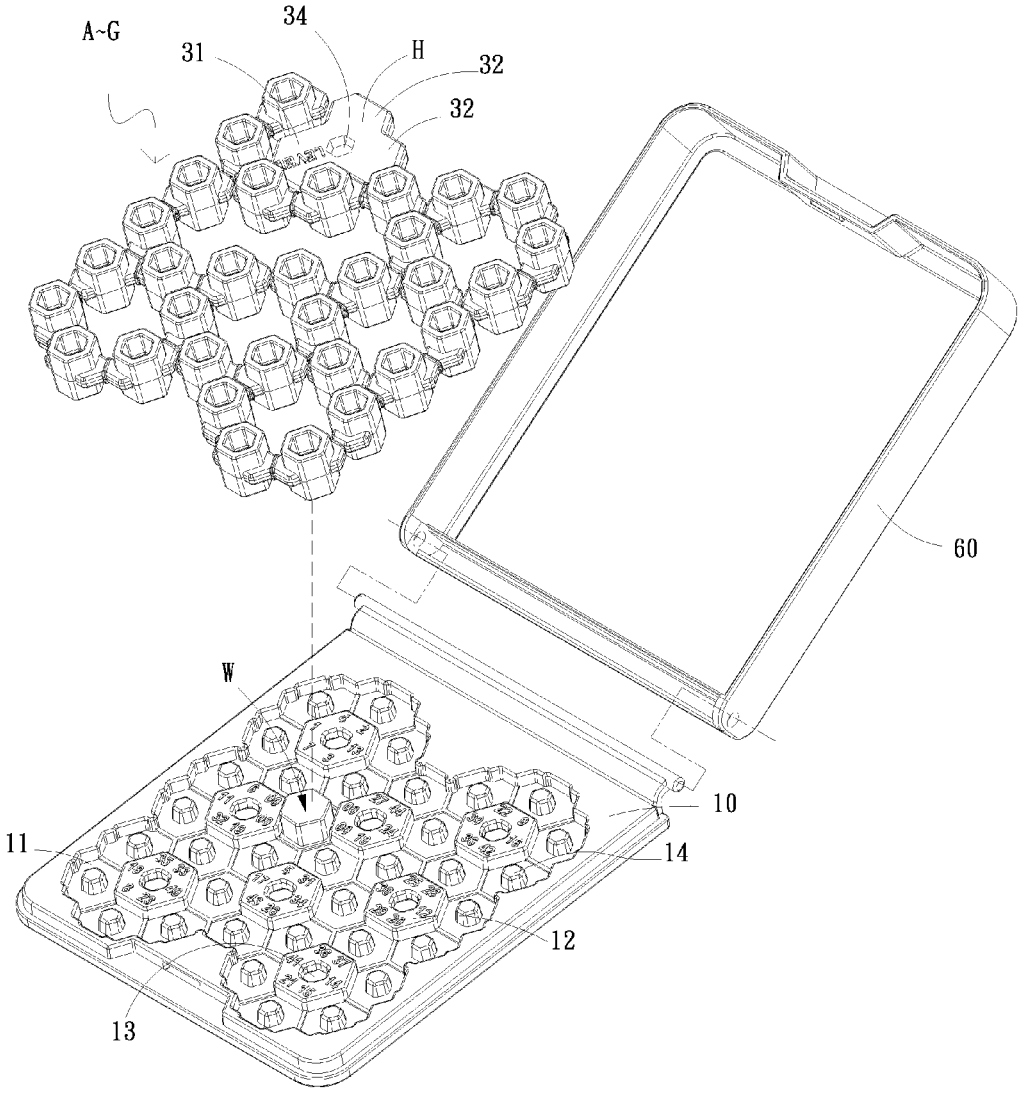
FIG. 1: Exploded view of present invention.
Figure 2:
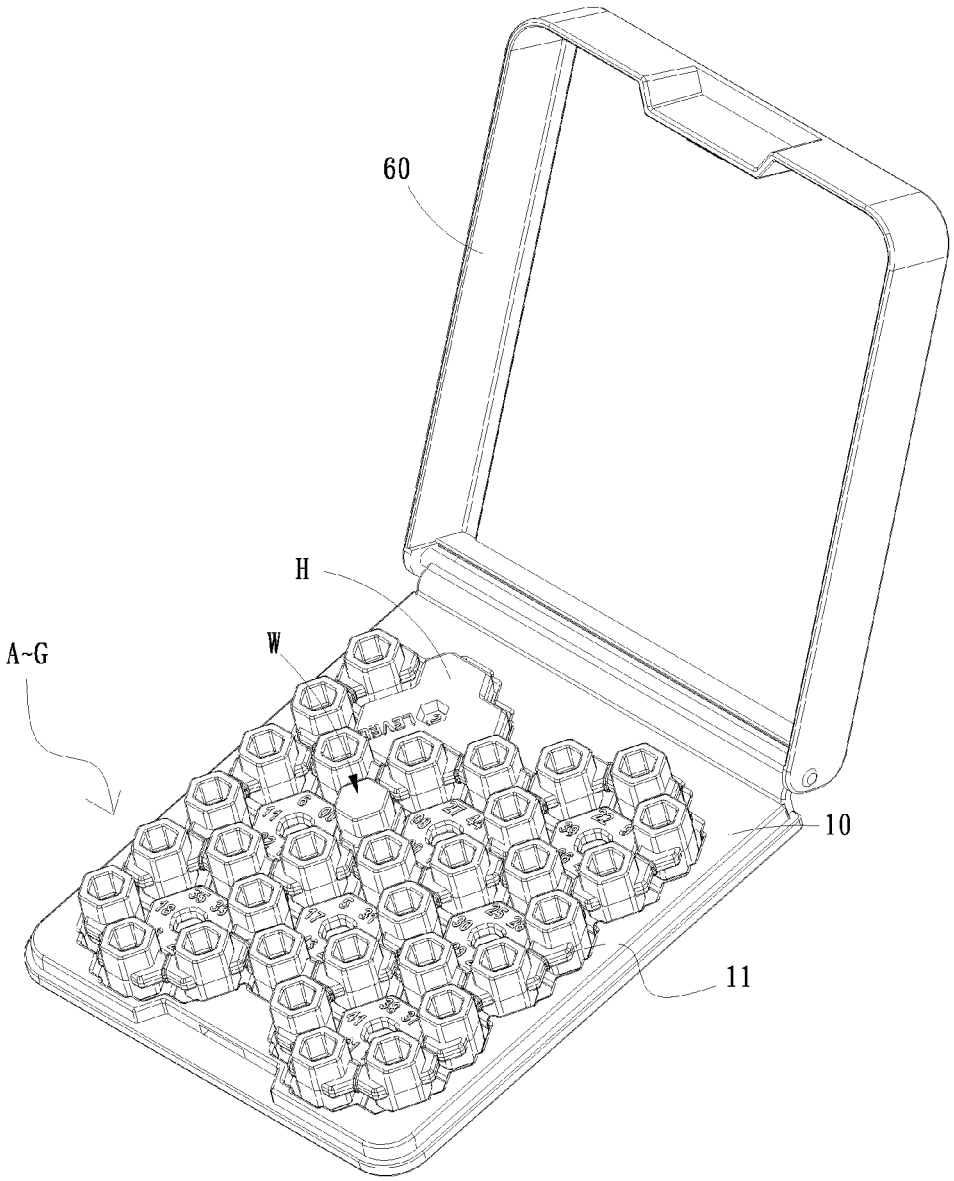
FIG. 2: Assembly drawing of present invention.

The detail of practice of the embodiment is as follow:

FIG. 1 and FIG. 2 reveal a kind of chain hexagonal bricks and base. Said chain hexagonal bricks and base are assembled by a base (10) with several grooves (11), a level selector (H) which is disposal on said groove (11), and 7 chain hexagonal bricks (A-G) with different shape which is disposal on said groove, and there is a cover (60) which is attached on one side of said base (10) which is for defending the dust. The shape of frames of said grooves (11) is a hexagon except the grooves which are on the edge of said base (10). The shape of frames of the grooves (11) which are on the edge of said base (10) is an irregular shape, and the area of said grooves (11) is larger than the hexagonal grooves (11) which is for the convenience of assembling and disassembling said hexagonal bricks to said base (10) by fingers.

Figure 3:
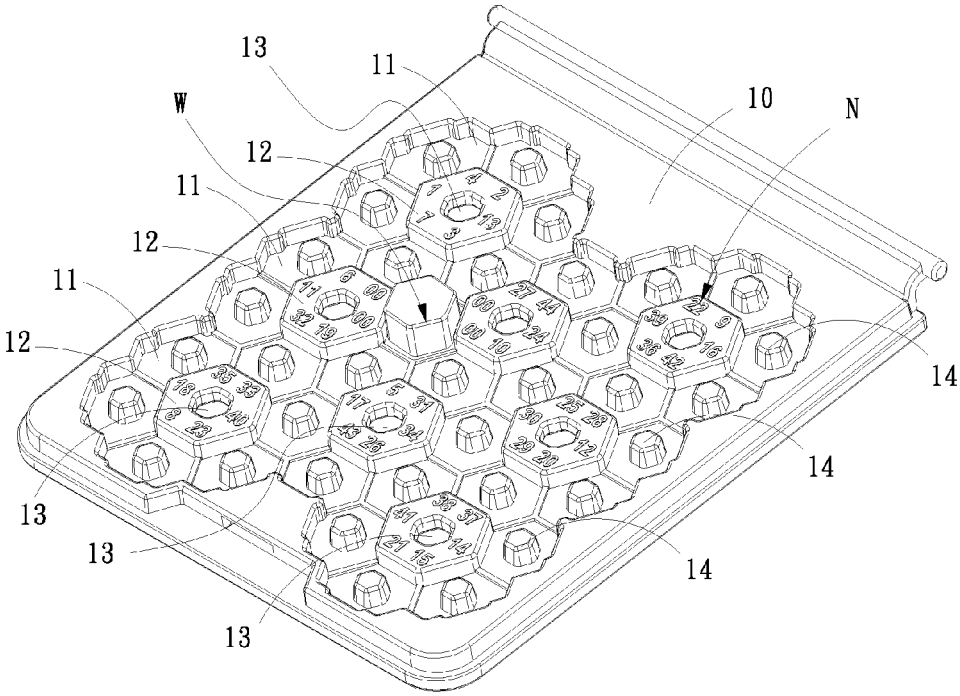
FIG. 3: Enlarged view of the base.
Figure 4:
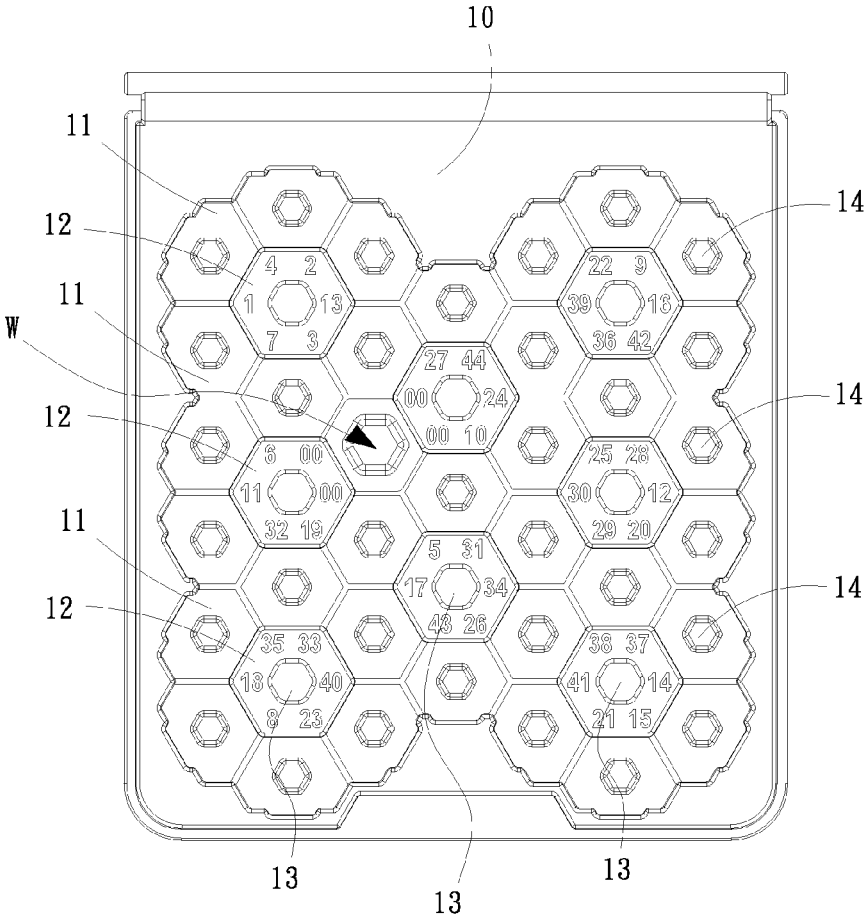
FIG. 4: Top view of the base.
Figure 5:
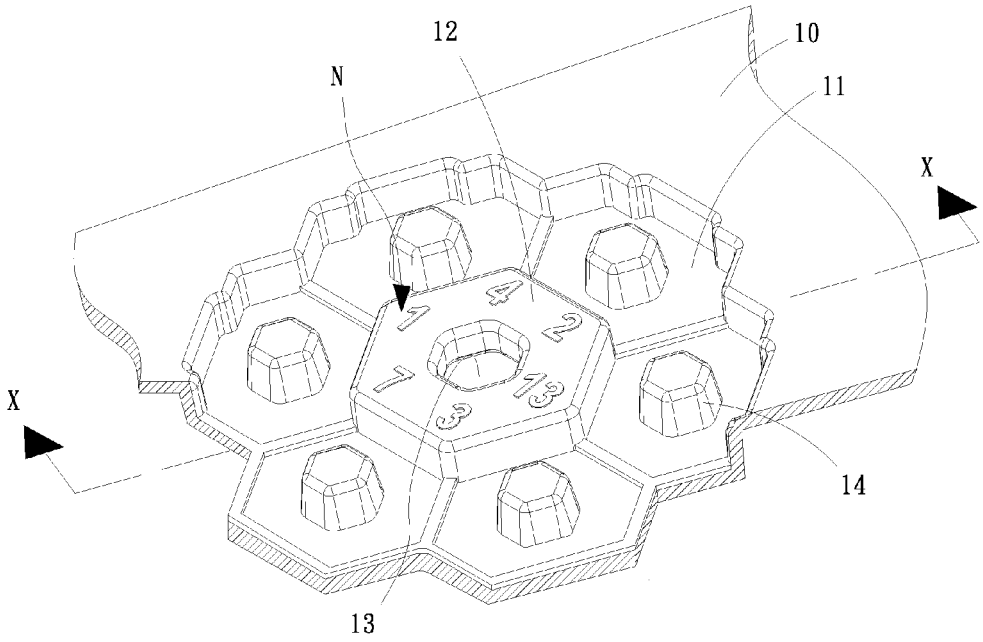
FIG. 5: Enlarged view of one of the hexagonal dock and 6 grooves.

FIG. 3, FIG. 4 and FIG. 5 reveal that there are 3 lists of hexagonal docks (12) which are disposed from the left to the right hand side of the top of said base (10); there are 3 hexagonal docks (12) on the first and third list, and 2 hexagonal docks (12) are on second list. Total 8 hexagonal docks (12) are lined in alternate permutation. There are 6 grooves (11) around every hexagonal docks (12), but there is only one groove (11) between 2 close hexagonal docks (12), and there is a hexagonal stud (W) which is disposed on one of said grooves (11), therefore, there are only 34 grooves (11) on the base (10) which are empty in the game.

There are 6 numbers (N) which are printed on the vertex of said every hexagonal docks (12), each number (N) represent a shape which is formed by said grooves (11). If the value of said number (N) is smaller, there are more ways to fill in grooves (11) with said 7 chain hexagonal bricks (A-G), otherwise, if the value of said number (N) is bigger, there are less ways to fill in grooves (11) with said 7 chain hexagonal bricks (A-G), and the game becomes more difficult. As FIG. 5 shown, for example, the numbers which are printed on the vertex of said hexagonal docks (12) are "1, 4, 2, 13, 3, 7", "1" is the smallest value of said numbers (N) herein. There are more than 50 ways of filling in the empty grooves (11) with said chain hexagonal bricks (A-G). "13" is the largest value of said numbers (N) herein. There are more than 30 ways of filling in the empty grooves (11) with said chain hexagonal bricks (A-G). That means the game with the number "13" is more difficult than the game with the number "1". Therefore, player is capable of recognizing the difficulty of the game by numbers (N).

In the embodiment of present invention, the numbers (N) are from "1" to "44". There are 50 ways of completing the game with the number "1" but only one way of completing the game with the number "44", therefore, The number "1" represents the simplest and the number "44" represents the hardest of completing the game. The beginner learns how to play from choosing the small numbers (N), and the player who want to challenge higher level is capable of choosing large numbers (N). That means the game is suitable for people in all ages who want to play easy or difficult game.

Figure 6:
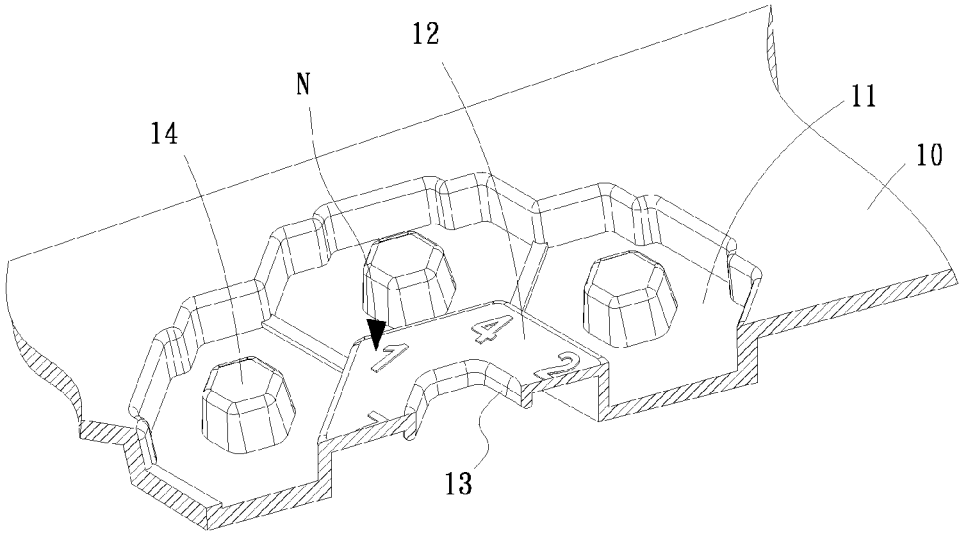
FIG. 6: Vertical cross section of FIG. 5.

As FIG. 5 and FIG. 6 shown, there is a hexagonal slot (13) which is in the center of said hexagonal dock (12), and there are 6 numbers (N) which are printed on the vertex of the top of said hexagonal dock (12). That also means the numbers (N) are deployed around the hexagonal slot (13). There are 6 grooves (11) around said hexagonal dock (12), and there is a protruding hexagonal plug (14) on each of said 34 grooves (11) which is disposed on the center of the bottom of said groove (33). The scheme of the function of said hexagonal slot (13) and protruding hexagonal plug (14) is shown in FIG. 10.

Figure 7:
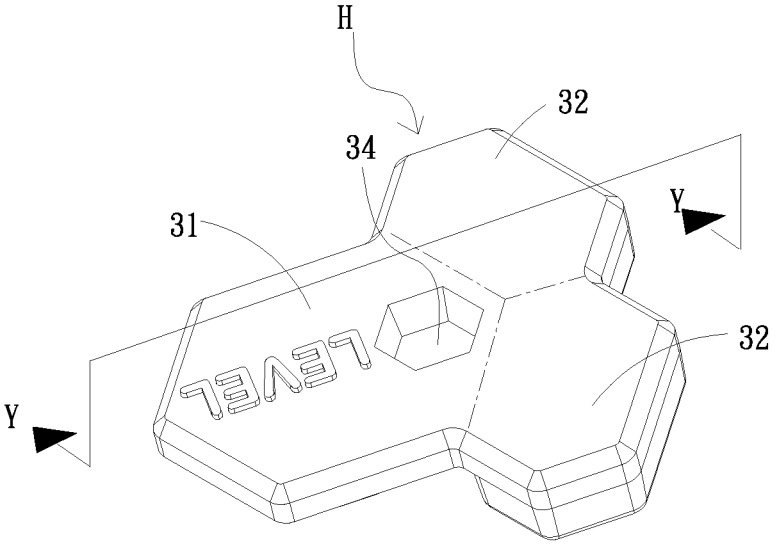
FIG. 7: Enlarge view of upward of level selector (H).
Figure 8:
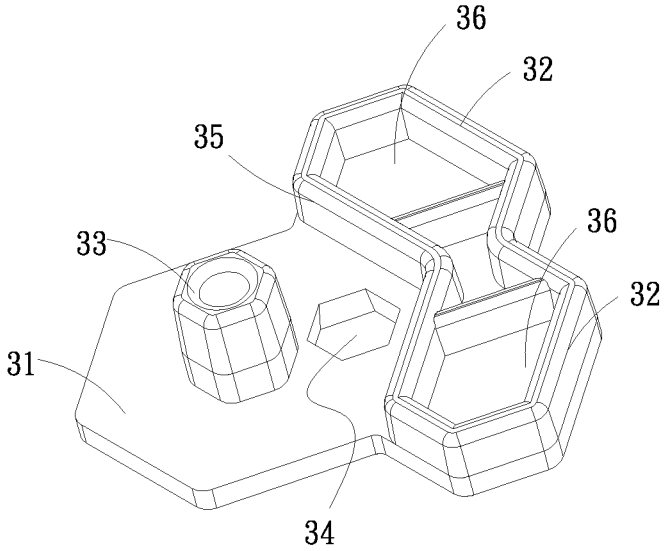
FIG. 8: Enlarge view of downward of level selector (H).
Figure 9:
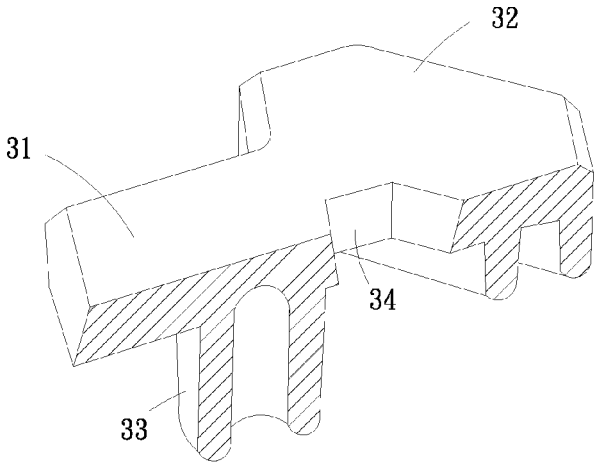
FIG. 9: Horizontal cross section of FIG. 8.

FIG. 7, FIG. 8 and FIG. 9 reveal a level selector (H), the structure is shown by imaging lines which are shown in the drawings herein. Said level selector (H) is assembled by a hexagonal large cover (31) and 2 small hexagonal covers (32). Said 2 small hexagonal covers (32) are connected to said hexagonal large cover (31) which are conjunct, and there is a window (34) among said hexagonal large cover (31) and 2 small hexagonal covers (32) for watching said numbers (N). Furthermore, there is a hexagonal column (33) which is disposed on the center of the bottom of said large hexagonal cover (31) on the level selector (H), and said 2 small hexagonal covers (32) on said level selector (H) are with protruding frames (35) which are more thick than said large hexagonal cover (31). Thus, there are symmetrical polygonal banks (36) which are formed on each of said protruding frames (35).

Said hexagonal large cover (31) is large enough to cover one of said hexagonal docks (12), and said 2 small hexagonal covers (32) large enough to cover 2 of said grooves (11), therefore, the amount of empty grooves (11) on the base (10) become 32, and said window makes only one number (N) of covered hexagonal dock (12) is visible. In other words, the left 5 numbers (N) of covered hexagonal dock (12) are covered by said hexagonal large cover (31), thus the player is capable of watching only one number (N) from the window (34) and realize the level of difficulty of the game.

Figure 10:
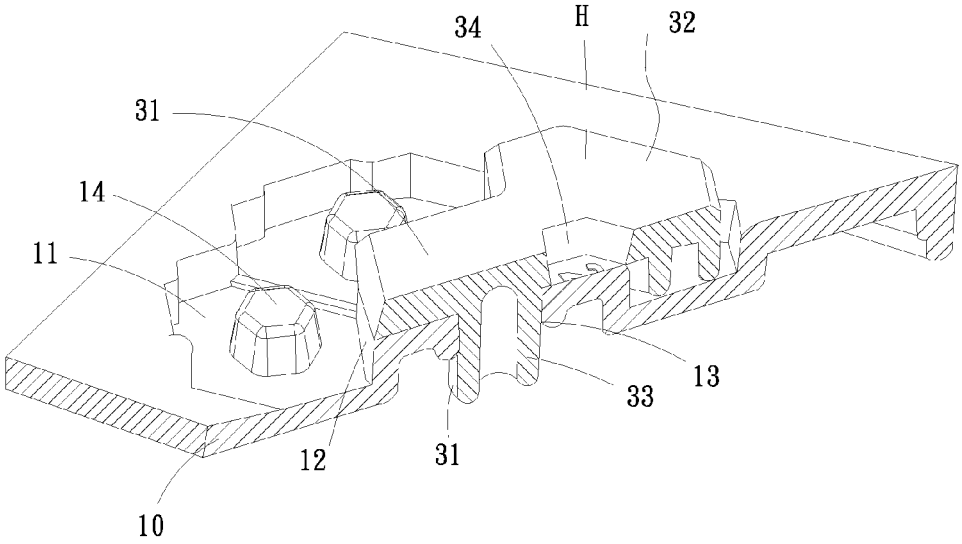
FIG. 10: Vertical cross section of fixed level selector (H) with base.
Figure 11:
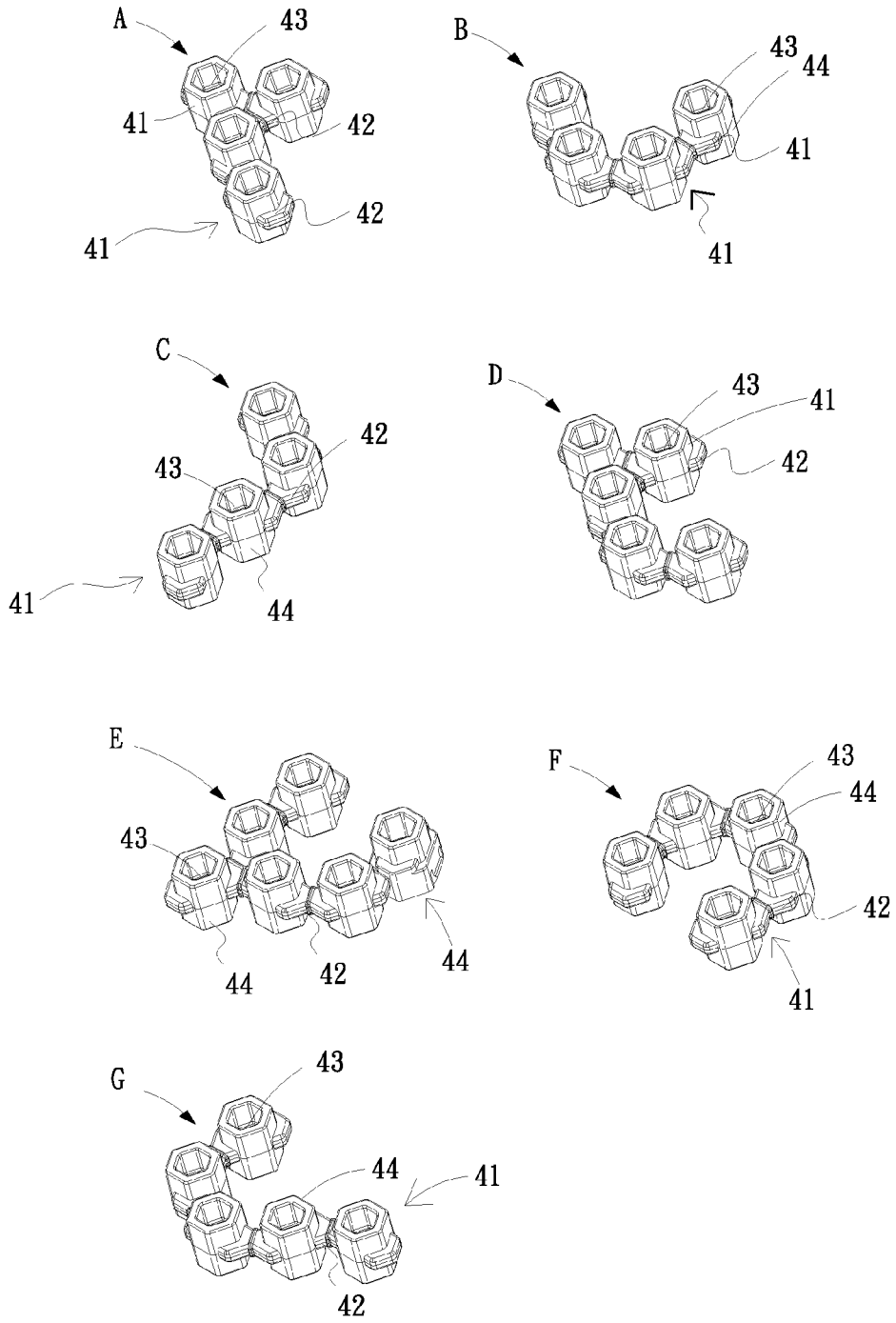
FIG. 11: Space diagram of 7 chain hexagonal bricks.
Figure 12:
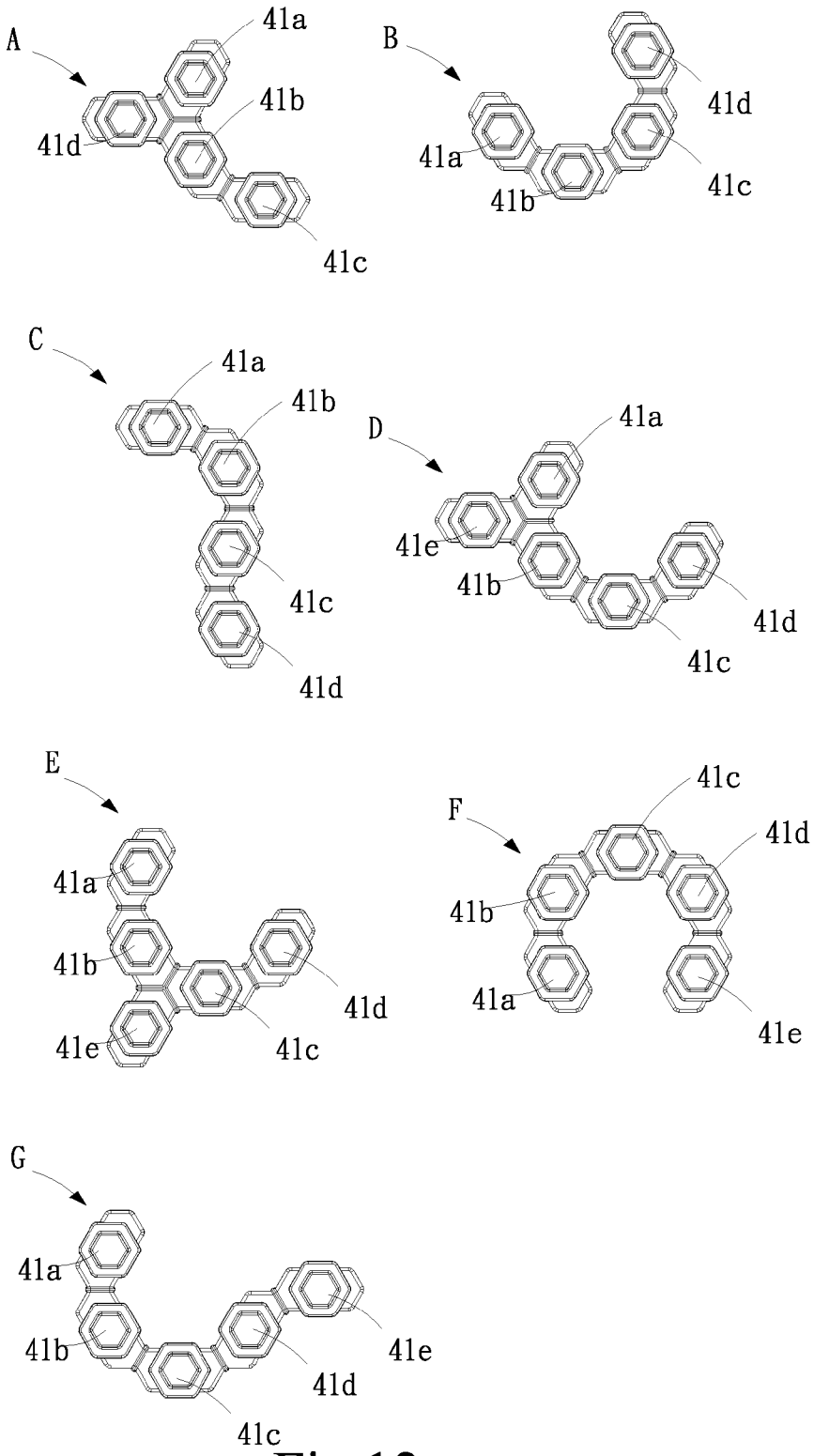
FIG. 12: Plan of 7 chain hexagonal bricks.

As FIG. 10 shown, the hexagonal column (33) is plugged into the hexagonal slot (13) and fixed when the hexagonal dock (12) is covered by the hexagonal large cover (31) which makes said hexagonal large cover (31) fixed and not capable of being turned; the 2 symmetrical polygonal banks (36) under said 2 small hexagonal covers (32) are insertable by the protruding hexagonal plugs (14) inside the grooves (11) to make said 2 small hexagonal covers (32) not capable of being turned (not be shown in the drawing). As above description, the function of said hexagonal slot (13) is for plugging by said hexagonal column (33) and fixing said hexagonal large cover (31), and the function of said protruding hexagonal plugs (14) is for fixing said small hexagonal covers (32) and 7 chain hexagonal bricks (A-G). Shapes of said 7 chain hexagonal bricks (A-G) are described as follow:

First chain hexagonal bricks (A): The C shape part is assembled by 3 chain units (41*a*-41*c*). The include angle between each 2 chain units (41) is 120 degrees. Fourth chain unit (41*d*) is attached between (41*a*) and (41*b*) with 120 degrees of include angle between (41*a*) and (41*b*).

Second chain hexagonal bricks (B) is assembled by 3 chain units (41*a*-41*c*) which are conjunct each other with 120 degrees of include angle and become a C shape.

Third chain hexagonal bricks (C): The C shape part is assembled by 3 chain units (41*a*-41*c*). The included angle between each 2 chain units (41) is 120 degrees; fourth chain unit (41*d*) is connected to another side of 41C in reversal direction.

Fourth chain hexagonal bricks (D): The C shape part is assembled by 4 chain units (41*a*-41*d*); The include angle between each 2 chain units (41) is 120 degrees. Fifth chain unit (41*e*) is attached between (41*a*) and (41*b*) with 120 degrees of include angle between (41*a*) and (41*b*).

Fifth chain hexagonal bricks (E): The C shape part is assembled by 4 chain units (41*a*-41*d*); The include angle between each 2 chain units (41) is 120 degrees. Fifth chain unit (41*e*) is attached between 41*b* and 41*c* with 120 degrees of include angle between (41*b*) and (41*c*).

Sixth chain hexagonal bricks (F) is assembled by 5 chain units (41*a*-41*e*) which are conjunct each other with 120 degrees of include angle and become a C shape.

Seventh chain hexagonal bricks (G): The C shape part is assembled by 4 chain units (41*a*-41*d*), and the include angle between each 2 chain units is 120 degrees. Fifth chain unit (41*e*) is connected to another side of (41*d*) in reversal direction.

Figure 13:
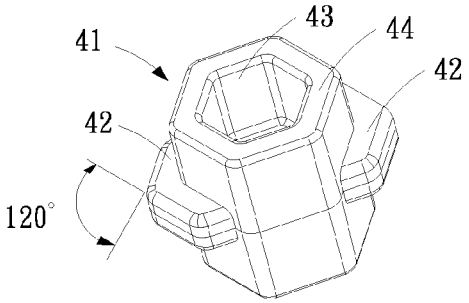
FIG. 13: Space diagram of single chain unit.

As FIG. 13 shown, chain unit (41) is assembled by a hexagonal column (44) and a horizontal protruding joint (42) which is disposed on relative sides of said chain unit (41). The include angle of the free end of said horizontal protruding joint (42) is 120 degrees; said chain hexagonal bricks herein said chain unit (41) are connect by said horizontal protruding joint (42). Said horizontal protruding joint (42) is not only for separating every chain unit (41) but also signifying the characteristic of outlook of said chain unit (41).

Figure 14:
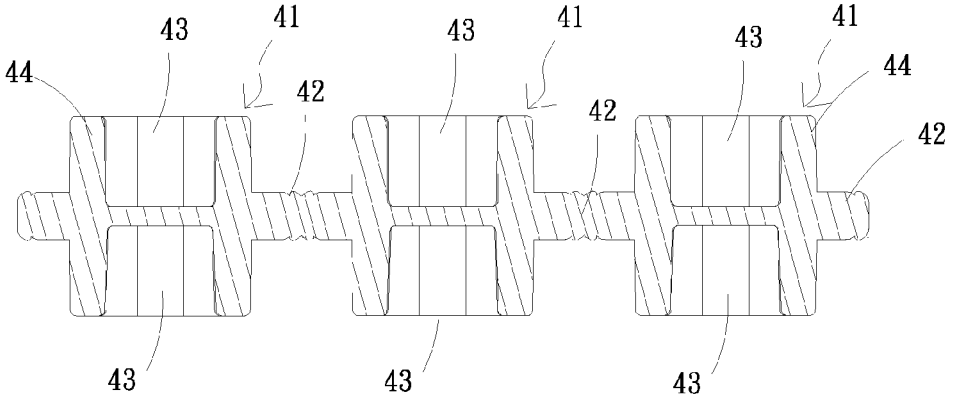
FIG. 14: Vertical cross section of a section of chain hexagonal bricks.
Figure 15:
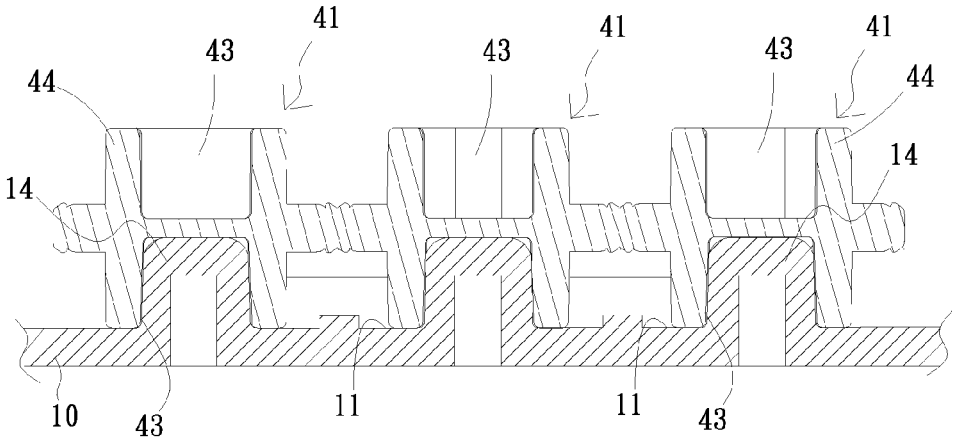
FIG. 15: Vertical cross section of connecting part of chain hexagonal bricks and groove.

As FIG. 14 shown, there are hexagonal sockets (43) which are on the upward and downward surface of said every chain units (41). That makes said 7 chain hexagonal bricks (A-G) are applicable whether being normal or upside down. As FIG. 15 shown, said hexagonal sockets (43) are reactive with said protruding hexagonal plug (14) which is disposed on the bottom of said 34 grooves (11). The said hexagonal sockets (43) is inserted by said protruding hexagonal plug (14) and fixing said chain units (41) to said grooves (11).

As FIG. 2 and FIG. 3 shown, said hexagonal stud (W) is fixed in one of said grooves (11) which are disposed on the base (10). Said hexagonal stud (W) is capable of connecting with the base (10) or as a separated independent unit, than getting fixed on one of said grooves (11) which are disposed on the base (10) by sticker or mechanic plugging or stuffing.

There is a reference that said hexagonal stud (W) has better not be disposed on the grooves (11) which are disposed on the edge of said base (10) to avoid the unsymmetrical shape between upward and downward or left and right. The best place to disposing said hexagonal stud (W) are the grooves on the left or right of the hexagonal docks of second list.

The purpose of deploying said hexagonal stud (W) is for stopping and interrupting filling in empty grooves (11) with said hexagonal chain hexagonal bricks (A-G). The difficulty of the game is increased by this design, thus the intelligence of player is inspired. Furthermore, the grooves (11) and hexagonal docks (12) on the base (10) are aligned symmetrically from left to right and upward to downward. That means half of shapes which are formed by empty grooves are the same, thus, the disposing of said hexagonal stud (W) is also for preventing happening of this situation.

Figure 16:
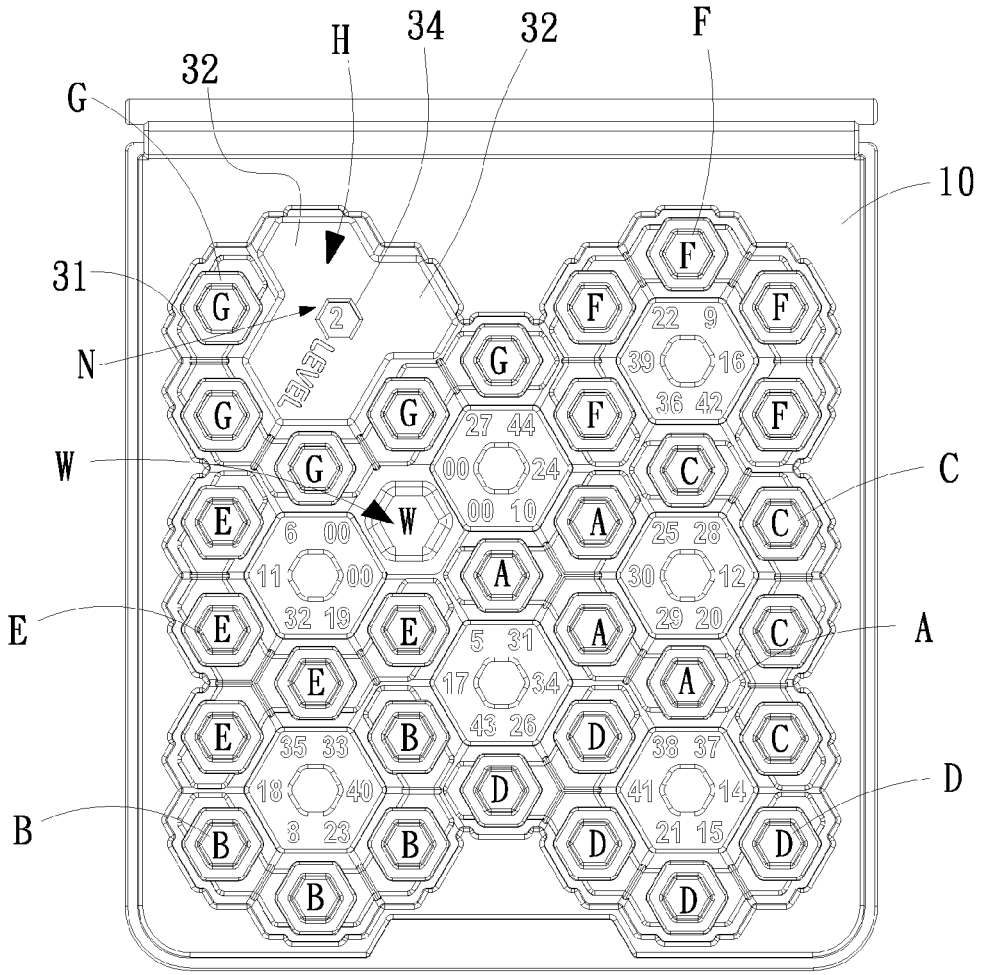
FIG. 16: Top view of level 2 completed game.
Figure 17:
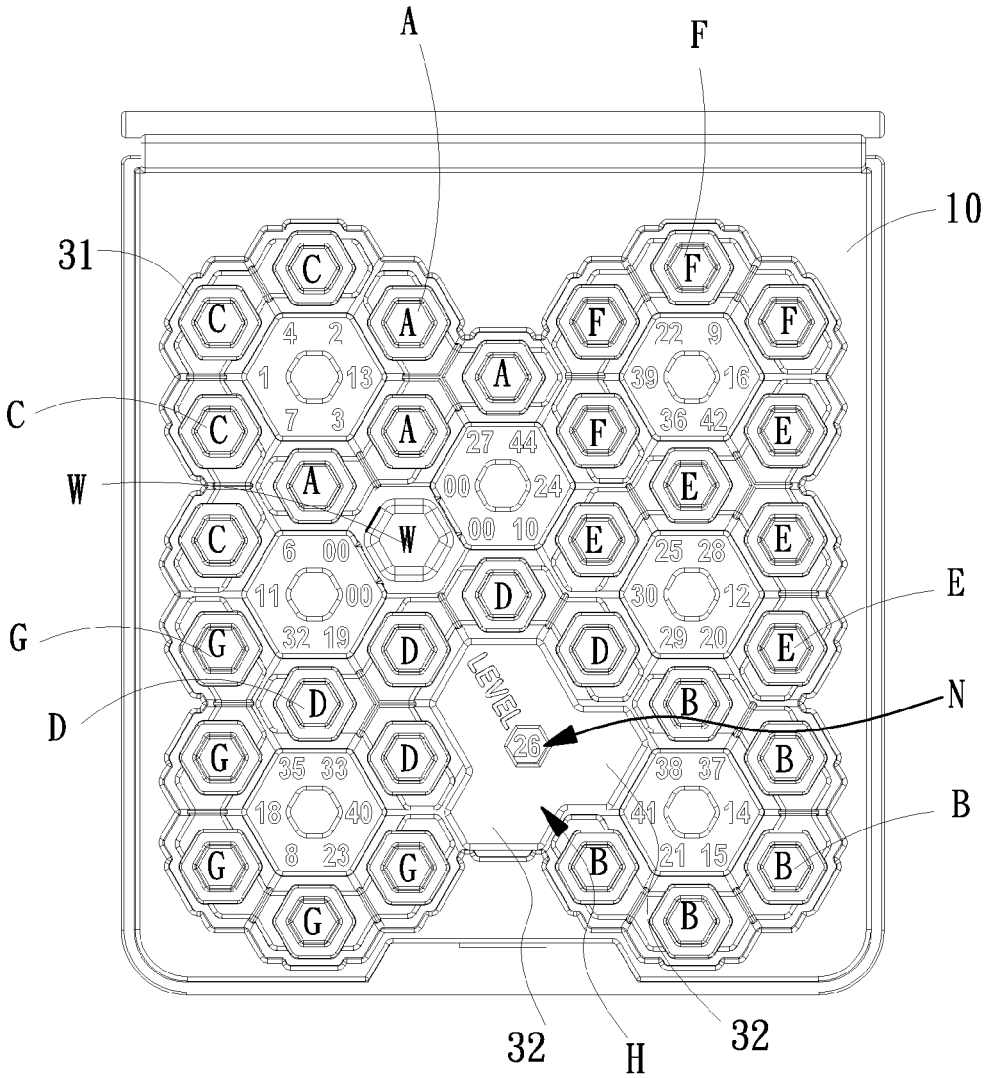
FIG. 17: Top view of level 26 completed game.

The way of playing the game is shown in FIG. 16, FIG. 17, they are different embodiments of filling in the grooves (11) with said chain hexagonal bricks (A-G). The procedure of completing the game describes as follow:

1. Check if said hexagonal stud (W) is fixed in one of said grooves (11). If it has not been fixed yet, find a groove to dispose said hexagonal stud (W), and the game is ready to start. There should only be 34 empty grooves (11) on the base (10) after disposing said hexagonal stud (W).
2. Find one of said hexagonal dock (12), and dispose said level selector (H) on the hexagonal dock (12). Said hexagonal dock (12) is cover by the hexagonal large cover (31) when said level selector (H) is disposed on said hexagonal dock (12). Only 32 empty grooves (11) for disposing said 7 chain hexagonal bricks (A-G) this time.
3. Filling in left grooves (11) with said 7 chain hexagonal bricks (A-G).

There are totally 32 chain units in said 7 chain hexagonal bricks (A-G) which is just enough for Filling in left grooves (11), and the way of playing the game is a little like a puzzle game. Player must use bricks with different shape to complete the shape which grouped by said grooves (11). In the process, the intelligence of player is inspired.

The position of said level selector (H) is different which is shown in FIG. 16 and FIG. 17. There are different ways of filling in empty grooves (11) with said 7 chain hexagonal bricks (A-G) due to the differences of the position of covered hexagonal dock (12) and 2 grooves (11). To recognize which way is harder is depend on the number (N) shows in the window of said level selector (H). The number (N) shows in FIG. 16 is "2"; The number (N) shows in FIG. 17 is "26", which means the game shows in FIG. 17 is harder than the one shows in FIG. 16.

What is claimed is:

1. An intellectual game model comprising:

A game assembly having a base and a cover, said base pivotably connected to said cover;

The base having a eight hexagonal docks protruding from said base in 3 columns and spaced from each other, a first and third column having 3 docks each and a middle second column having 2 docks, hexagonal dock including a top hexagonal surface;

Said top hexagonal surface on each dock including a plurality of numbers, each number representing a degree of difficulty;

Each of said dock further surrounded by 6 of hexagonal grooves and at least one groove interconnect adjacent grooves;

A hexagonal stud protruding and disposed in a hexagonal groove at approximately central hexagonal groove intermediate two docks;

A hexagonal plug protruding and disposed central of each groove, the hexagonal plug being dimensionally smaller than the hexagonal stud;

A level selector configured large enough to completely cover a dock and 2 smaller plugs, a first portion of the cover being shaped to cover one hexagonal dock and a second portion of the cover being conjoined to cover 2 smaller plugs, wherein the first portion of cover having a window making a number on the hexagonal dock visible when the level selector is positioned on to cover a hexagonal dock and 2 smaller plugs;

7 chain bricks, each chain brick assembled by a plurality of chain units, each chain unit configured in shape of a hexagonal column, where in first and third chain bricks each having 4 chain units, fourth to seventh chain bricks each having 5 chain units, and totally 32 chain units in the game.

2. An intellectual game model according to claim 1 wherein the center of each said hexagonal dock has a hexagonal slot.

3. An intellectual game model according to claim 1 wherein said second portion of the cover on the level selector are with protruding frames which are thicker than said first portion of the cover on said level selector.

4. An intellectual game model according to claim 1 wherein the upward and downward surface of each said chain units both have a hexagonal socket.

5. An intellectual game model according to claim 1 wherein each said chain unit has a horizontal protruding joint disposed on relative sides, furthermore, the include angle of the free end of said horizontal protruding joint is 120 degrees.

* * * * *